US011615907B2

(12) United States Patent
Kobayashi et al.

(10) Patent No.: US 11,615,907 B2
(45) Date of Patent: Mar. 28, 2023

(54) REACTOR

(71) Applicants: AutoNetworks Technologies, Ltd., Yokkaichi (JP); Sumitomo Wiring Systems, Ltd., Yokkaichi (JP); Sumitomo Electric Industries, Ltd., Osaka (JP)

(72) Inventors: Takehito Kobayashi, Yokkaichi (JP); Kohei Yoshikawa, Yokkaichi (JP); Naotoshi Furukawa, Yokkaichi (JP); Masaya Murashita, Yokkaichi (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 373 days.

(21) Appl. No.: 17/036,868

(22) Filed: Sep. 29, 2020

(65) Prior Publication Data

US 2021/0098171 A1 Apr. 1, 2021

(30) Foreign Application Priority Data

Sep. 30, 2019 (JP) ..... JP2019-180158

(51) Int. Cl.

| | |
|---|---|
| ***H01F 27/24*** | (2006.01) |
| ***H01F 27/02*** | (2006.01) |
| ***H01F 27/22*** | (2006.01) |
| ***H01F 37/00*** | (2006.01) |
| *H01F 27/32* | (2006.01) |

(52) U.S. Cl.

CPC ..... *H01F 27/022* (2013.01); *H01F 27/025* (2013.01); *H01F 27/22* (2013.01); *H01F 27/24* (2013.01); *H01F 37/00* (2013.01); *H01F 27/32* (2013.01)

(58) Field of Classification Search

CPC ..... H01F 27/022; H01F 27/025; H01F 27/22; H01F 27/24; H01F 37/00; H01F 27/32

See application file for complete search history.

(56) References Cited

U.S. PATENT DOCUMENTS

2021/0082612 A1* 3/2021 Furukawa ..... H01F 37/00

FOREIGN PATENT DOCUMENTS

JP 2013-131567 A 7/2013
WO WO-2020145276 A1 * 7/2020 ..... H01F 27/022

* cited by examiner

*Primary Examiner* — Tuyen T Nguyen
(74) *Attorney, Agent, or Firm* — Honigman LLP

(57) ABSTRACT

A reactor includes an assembly, stored in a case, including a coil and a magnetic core; an insertion member, having a type A durometer hardness of 50 or higher, that is stored side-by-side with the assembly; and a sealing resin portion that fills the case. The case includes a bottom portion and a side wall portion. The insertion member includes a leading end portion separated from the bottom portion via a gap. A space formed between the assembly and the case and between the insertion member and the case includes a first region provided between the bottom portion and the leading end portion and a second region that is a region other than the first region. The sealing resin portion includes a first resin portion that fills the first region and a second resin portion that fills at least a portion of the second region.

10 Claims, 7 Drawing Sheets

REACTOR

CROSS-REFERENCE TO RELATED APPLICATIONS

This application claims priority of Japanese Patent Application No. JP 2019-180158 filed on Sep. 30, 2019, the contents of which are incorporated herein.

TECHNICAL FIELD

The present disclosure relates to a reactor.

BACKGROUND ART

JP 2013-131567A discloses a reactor that includes a coil, a magnetic core, a quadrangular box-shaped case, and a sealing resin portion. The case contains an assembly of the coil and the magnetic core and is filled by the sealing resin portion. Hereinafter, the material that contains uncured resin and serves as the raw material of the sealing resin portion will also be called "raw resin".

SUMMARY

In the case of a reactor that includes a case and a sealing resin portion, there is desire for reducing the need amount of sealing resin. There is also desire for a reactor that has excellent heat dissipation performance.

The reactor described in JP 2013-131567A has excellent heat dissipation performance due to the assembly being surrounded by the sealing resin portion. This is because the sealing resin portion transmits the heat generated by the assembly to the case. However, because the sealing resin portion completely surrounds the assembly, a large amount of sealing resin is required. The larger the filler amount of the sealing resin is, the longer the raw resin filling time is. In particular, if regions having a narrow gap (e.g., 1 mm or less) between the assembly and the case are provided in order to improve the heat dissipation performance, it is difficult for the raw resin to flow through such narrow regions. As a result, the filling time is likely to become longer. If the filling time is reduced and unfilled regions appear, variations arise in the heat dissipation performance. Also, if the raw resin has a high viscosity, it is even more difficult for the raw resin to flow through the narrow regions, and the filling time is likely to become even longer. In view of these points, there is room for improvement in terms of manufacturability.

In view of this, an object of the present disclosure is to provide a reactor that reduces the filler amount of the sealing resin while also having excellent heat dissipation performance.

A reactor according to the present disclosure includes an assembly including a coil and a magnetic core; a case in which the assembly is stored; an insertion member that is stored side-by-side with the assembly in the case; and a sealing resin portion that fills the case. The case includes a bottom portion and a side wall portion. The insertion member includes a leading end portion disposed so as to be separated from the bottom portion via a gap, and a space is formed between the assembly and the case and between the insertion member. The case includes a first region provided between the bottom portion and the leading end portion and a second region that is a region other than the first region. The sealing resin portion includes a first resin portion that fills the first region and a second resin portion that fills at least a portion of the second region, and a constituent material of the insertion member has a type A durometer hardness of 50 or higher.

The above reactor of the present disclosure reduces the filler amount of the sealing resin while also having excellent heat dissipation performance.

DETAILED DESCRIPTION OF EMBODIMENTS OF THE PRESENT DISCLOSURE

Figure 1:
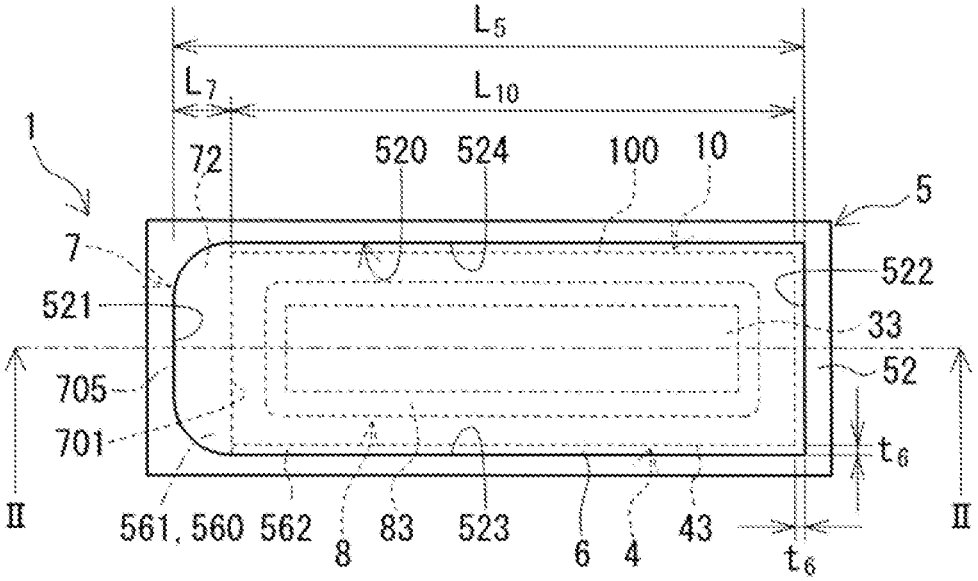
FIG. 1 is a plan view of a reactor according to a first embodiment, as seen in the depth direction of a case.

First, embodiments of the present disclosure will be listed and described.

A reactor according to the present disclosure includes an assembly including a coil and a magnetic core; a case in which the assembly is stored; an insertion member that is stored side-by-side with the assembly in the case; and a sealing resin portion that fills the case. The case includes a bottom portion and a side wall portion. The insertion member includes a leading end portion disposed so as to be separated from the bottom portion via a gap, and a space is formed between the assembly and the case and between the insertion member. The case includes a first region provided between the bottom portion and the leading end portion and a second region that is a region other than the first region. The sealing resin portion includes a first resin portion that fills the first region and a second resin portion that fills at least a portion of the second region, and a constituent material of the insertion member has a type A durometer hardness of 50 or higher.

According to the above reactor of the present disclosure, it is possible to eliminate an amount of sealing resin that corresponds to the volume of the insertion member, thus reducing the filler amount of the sealing resin. The above reactor of the present disclosure also has excellent heat dissipation performance. The reason for this is that at least a portion of the second resin portion fills the space between the assembly and the case and covers at least a portion of the assembly, and therefore heat generated by the assembly is transmitted to the case by the second resin portion. If the gap between the assembly and the case has a narrow portion (e.g., a gap less than or equal to 1 mm), heat generated by the assembly is more easily transmitted to the case, thus further improving the heat dissipation performance.

Furthermore, for the following reasons A to C, the above reactor of the present disclosure can shorten the time required for the filling of a material that contains uncured resin serving as the raw material of the sealing resin portion (i.e., the time required for the filling of raw resin), and therefore also has excellent manufacturability.

The amount of raw resin needed to fill the case is lower than in the case of not including the insertion member.

A relatively large portion of the space provided in the case can be filled with the raw resin in the processing manufacturing the reactor.

Specifically, in the state where the assembly has been stored in the case but the insertion member has not been stored therein, the space in the case can have a region that is large enough for the arrangement of the insertion member and a narrow region that surrounds the assembly. The former region can be set larger than the narrow region, in accordance with the size of the insertion member. If this relatively large region is filled with the raw resin, the filling time is likely to be shorter than in the case where the narrow region is filled with the raw resin. Also, a nozzle for introducing the raw resin can be disposed in the relatively large region. In other words, a nozzle can be used to introduce the raw resin. Note that at least a portion of the raw resin introduced to the relatively large region constitutes the first resin portion after curing.

The raw resin introduced to the relatively large region can be pressed by the insertion member. This is because the insertion member has a predetermined hardness.

The pressed raw resin flows from the insertion member side to the assembly side in the case and enters the narrow region. Due to using the insertion member as a member for pressing the raw resin, even if the gap between the assembly and the case has a narrow region (e.g., less than or equal to 1 mm), the raw resin can favorably flow into the narrow region and cover the assembly.

Due to the above-described pressing of the raw resin, even if a region is narrow, and even if the raw resin has a high viscosity, it is possible to suppress the formation of regions not filled by the raw resin. In view of these points as well, the reactor of the present disclosure has excellent heat dissipation performance.

In another aspect of the reactor of the present disclosure, the constituent material contains a resin or a rubber material.

According to the above aspect, compared with the case where the constituent material is a metal material, the electrical insulation is better between the assembly and the insertion member, and the weight is lighter. Also, if the insertion member is made of a rubber material in particular, the insertion member more easily undergoes elastic deformation than in the case of being made of a metal material, and the insertion member is likely to conform to the shape of the space in the case for storing the insertion member. For this reason, in the case of being made of a rubber material, the insertion member can more easily press the raw resin.

In an aspect of the reactor in section (2) above, the constituent material of the leading end portion is the rubber material, the leading end portion includes an end face that is in contact with the first resin portion, and the area of the end face of the leading end portion when not undergoing elastic deformation is greater than or equal to a maximum plane area of the first region.

In the above aspect, in the process of manufacturing the reactor, the leading end portion made of a rubber material can press, in a nearly liquid-tight manner, the raw resin introduced into the relatively large region. The pressed raw resin is likely to enter even the narrow region.

In an aspect of the reactor of the present disclosure, the length of the insertion member along a depth direction of the case is greater than or equal to 40% of the depth of the case.

In the above aspect, the volume of the insertion member is large, thus further reducing the filler amount of the raw resin.

In an aspect of the reactor of the present disclosure, a constituent material of the sealing resin portion contains a resin and a powder made of a non-metallic inorganic material.

In the above aspect, due to containing the powder, the sealing resin portion has excellent thermal conductance, thus achieving excellent heat dissipation performance. Also, in the above aspect, in the process of manufacturing the reactor, even if the raw resin has a high viscosity due to containing the powder, even the narrow region can be favorably filled with the raw resin by pressing the insertion member as described above.

The following describes specific examples of reactors according to embodiments of the present disclosure with reference to the drawings. Like reference signs in the drawings denote members having like names.

First Embodiment

The following describes a reactor of a first embodiment with reference to FIGS. 1 to 5.

Figure 2:
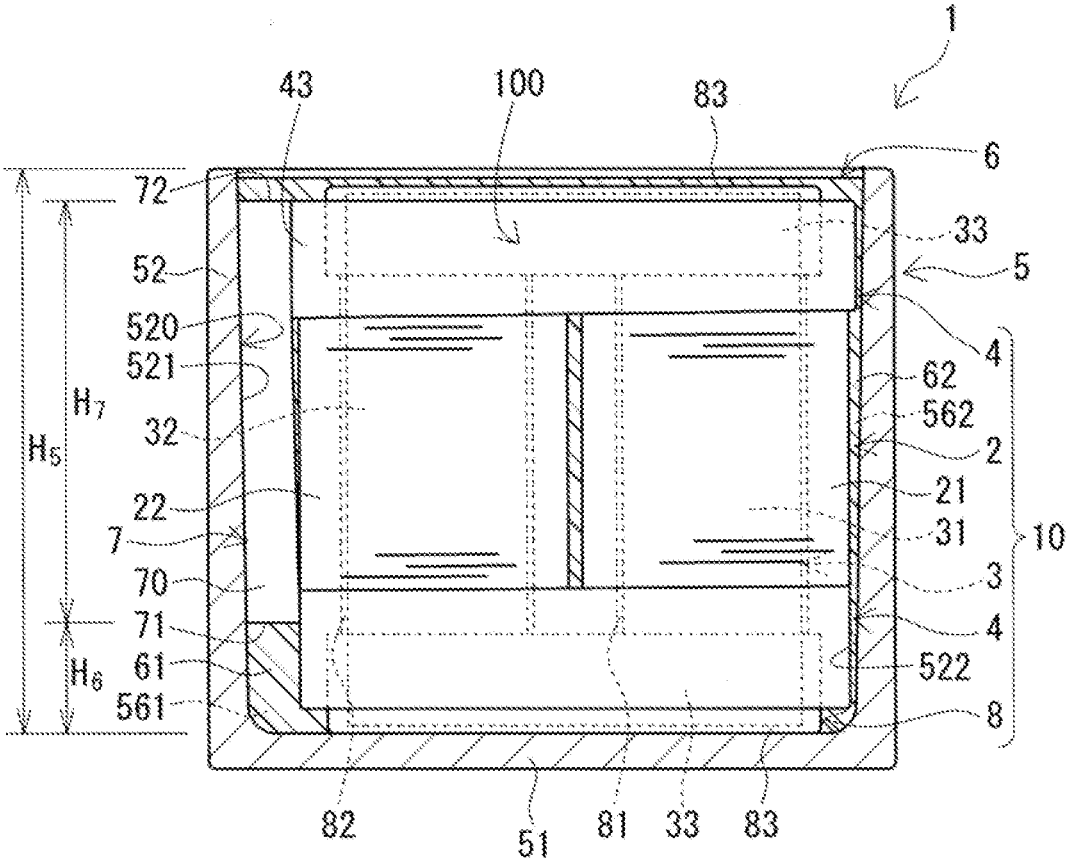
FIG. 2 is a partial cross-sectional view of the reactor in FIG. 1, taken along a cutting line II-II.

FIG. 2 is a partial cross-sectional view of the reactor in FIG. 1, taken along a plane that is parallel to the depth direction of a case 5 and cuts through the case 5 and sealing resin portion 6. An assembly 10 and an insertion member 7 in FIG. 2 are shown in an exterior view rather than in a cross-sectional view.

1. Overview

As shown in FIG. 2, the reactor 1 of the first embodiment includes the assembly 10, in which a coil 2 and a magnetic core 3 are provided, the case 5, the sealing resin portion 6, and the insertion member 7. The case 5 includes a bottom portion 51 and a side wall portion 52, and is a container in which the assembly 10 and the insertion member 7 are stored. The sealing resin portion 6 fills the case 5.

In particular, in the reactor 1 of the first embodiment, the assembly 10 and the insertion member 7 are stored in the case 5 side-by-side in a direction orthogonal to the depth direction of the case 5. The insertion member 7 includes a leading end portion 70 that is disposed spaced apart from the bottom portion 51 of the case 5. The sealing resin portion 6 includes a first resin portion 61 that fills the space between the bottom portion 51 and the leading end portion 70. The sealing resin portion 6 also fills the region in the case 5 other than the region filled by the first resin portion 61.

The insertion member 7 contributes to a reduction in the amount of the sealing resin portion 6 that is required. Also, the constituent material that forms the insertion member 7 has a specific hardness that will be described later. For this reason, in the process of manufacturing the reactor 1, the insertion member 7 can be used to press raw resin 600 (FIG. 5) introduced into the case 5, that is to say, the material that contains uncured resin serving as the raw material of the sealing resin portion 6. As a result, the insertion member 7 contributes to shortening the filling time of the raw resin 600.

Mainly using FIG. 2, the following describes an overview of the assembly 10, the case 5, and the sealing resin portion 6, and then describes the insertion member 7 and the sealing resin portion 6 in detail.

Figure 4A:
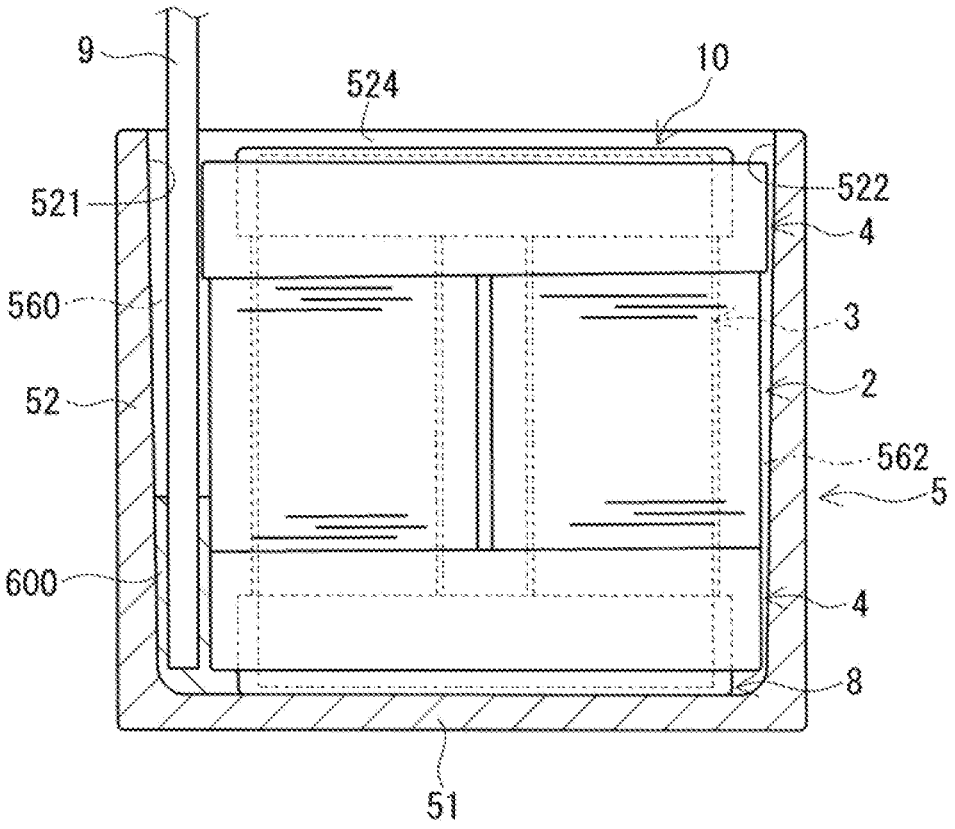
FIG. 4A is a partial cross-sectional view of a step for manufacturing the reactor of the first embodiment, and shows a state in which the case is filled with a raw resin.
Figure 4B:
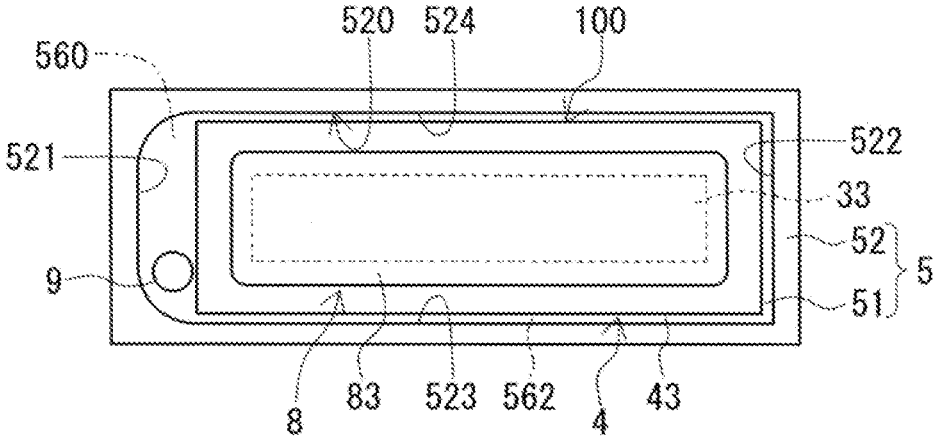
FIG. 4B is a plan view of a step for manufacturing the reactor of the first embodiment, and shows a state in which the case is filled with the raw resin.

Note that the depth direction of the case 5 is the direction orthogonal to the paper surface in FIGS. 1 and 4B, and is the up-down direction in the other figures.

For example, the direction orthogonal to the depth direction of the case 5 is the left-right direction in FIGS. 1 to 5.

2. Assembly

The assembly 10 includes the coil 2 and the magnetic core 3. The assembly 10 may also include a member for improving the electrical insulation between the coil 2 and the magnetic core 3, for example. Examples of such members include holding members 4 and a resin molded portion 8 that are described later.

2.1. Coil

The coil 2 includes tube-shaped winding portions constituted by a winding wire that has been wound into a spiral. An external apparatus such as a power supply is connected to winding wire end portions that are continuous with the winding portions. The winding wire, the winding wire end portions, and the external apparatus are not shown in the figures.

For example, the winding wire is a coated wire that includes a conductor wire and an insulating coating that surrounds the conductor wire. The constituent material of the conductor wire is copper, for example. The constituent material of the insulating coating is a resin such as polyamide imide, for example. In the present embodiment, the winding wire is a coated rectangular wire that has a rectangular cross-section.

In the present embodiment, the coil 2 has two winding portions 21 and 22 and a coupling portion that connects the winding portions 21 and 22. The coupling portion is not shown in the figures. The winding portions 21 and 22 are arranged side-by-side with parallel axes. In the present embodiment, the winding portions 21 and 22 have the same specifications (e.g., shape, winding direction, number of turns, and winding wire size). Also, in the present embodiment, the coil 2 is constituted by one continuous winding wire. The coupling portion is constituted by the portion of the winding wire that extends between the winding portions 21 and 22.

In the present embodiment, the winding portions 21 and 22 are quadrangular tube-shaped edgewise coils. In this case, the outer peripheral faces of the winding portions 21 and 22 tend to be flat rectangular faces. As a result, the outer peripheral surfaces of the winding portions 21 and 22 and an inner peripheral surface 520 of the case 5 are flat surfaces that face each other. For this reason, the gaps between the winding portions 21 and 22 and the inner peripheral surface 520 of the case 5 can be adjusted easily.

Note that the shape, size, and the like of the coil 2 can be changed as appropriate. See later-described Variation 4 as an example of this.

2.2. Magnetic Core

The magnetic core 3 includes portions that are disposed inside the winding portions 21 and 22 of the coil 2 and portions that are disposed outside the winding portions 21 and 22, and constitutes a closed magnetic circuit for the passage of magnetic flux generated by the coil 2.

In the present embodiment, the magnetic core 3 includes four columnar core pieces. Two of the core pieces are inner core portions 31 and 32 that have the portions that are disposed inside the winding portions 21 and 22. The remaining two core pieces are outer core portions 33 that constitute the portions that are disposed outside the winding portions 21 and 22. The two outer core portions 33 sandwich the two inner core portions 31 and 32, which are spaced apart.

In the present embodiment, the core pieces that constitute the inner core portions 31 and 32 have the same shape and the same size. These core pieces are cuboid and substantially correspond to the inner shape of the winding portions 21 and 22. Also, these core pieces are monolithic and not divided into sections.

In the present embodiment, the core pieces that constitute the outer core portions 33 have the same shape and the same size. These core pieces are cuboid, but there are no particular limitations on the shape thereof. Also, these core pieces are monolithic and not divided into sections.

For example, the core pieces that constitute the magnetic core 3 are compacts mainly made of a soft magnetic material. The soft magnetic material may be metallic or non-metallic. Examples of metals that can be used include iron and an iron-based alloy. Examples of iron-based alloys include an Fe—Si alloy and an Fe—Ni alloy. One example of a non-metal that can be used is ferrite. Examples of the compact include a compact of a composite material, a powder compact, a laminated body of soft magnetic material plate members such as magnetic steel plates, and a sintered body such as a ferrite core.

A composite material compact contains a magnetic powder and a resin. The magnetic powder is dispersed in the resin. Examples of the resin include a thermoplastic resin and a thermosetting resin. Examples of the thermoplastic resin include polyphenylene sulfide (PPS) resin, polytetrafluoroethylene (PTFE) resin, liquid crystal polymer (LCP), polyamide (PA) resin such as nylon 6 or nylon 66, polybutylene terephthalate (PBT) resin, and acrylonitrile butadiene styrene (ABS) resin. Examples of the thermosetting resin include unsaturated polyester resin, epoxy resin, urethane resin, and silicone resin. A composite material compact is typically molded using injection molding, for example.

A powder compact is an aggregate of a magnetic powder. A powder compact is typically obtained by subjecting a mixed powder containing a magnetic powder and a binder to compression molding and then performing heat treatment, for example.

Examples of the powder particles that constitute magnetic powder include magnetic particles made of a soft magnetic material, and coated particles constituted by magnetic particles coated with an insulating coating.

In the case where the magnetic core 3 includes multiple core pieces, all of the core pieces may be made of the same constituent material, or some of the core pieces may be made of a different constituent material. For example, in the present embodiment, the magnetic core 3 includes core pieces constituted by a composite material compact, and core pieces constituted by a powder compact. Alternatively, all of the core pieces may be constituted by a composite material compact, or the core pieces may contain different types of soft magnetic materials and contain different amounts of magnetic powder.

Also, although the magnetic core 3 shown in FIG. 2 does not have a magnetic gap between the core pieces, a magnetic gap may be provided. The magnetic gap may be an air gap, or may be constituted by a plate member made of a non-magnetic material such as alumina. The size of the magnetic core 3 can be reduced more easily if the magnetic gap is not provided.

Note that the shape, size, number of core pieces, and the like of the magnetic core 3 can be changed as appropriate. See later-described Variation 5 as an example of this.

2.3. Holding Members

The reactor 1 may include holding members 4 that are disposed between the coil 2 and the magnetic core 3. In the present embodiment, the holding members 4 support the winding portions 21 and 22, the inner core portions 31 and 32, and the outer core portions 33, and position the inner core portions 31 and 32 and the outer core portions 33 relative to the winding portions 21 and 22. The holding members 4 are shown schematically in FIGS. 1 to 5, but are not shown in detail.

In the present embodiment, the holding members 4 are frame-shaped members disposed at the end portions of the winding portions 21 and 22. Each holding member 4 includes a frame plate provided with a pair of through-holes, and a peripheral wall 43 that extends along the peripheral edge of the frame plate. The holding members 4 have the same basic configuration.

The frame plate of each holding member 4 is disposed between the end faces of the winding portion 21 and 22 and the inward end face of one of the outer core portions 33. The end portions of the inner core portions 31 and 32 are inserted through the through-holes provided in the frame plate. The frame plate also includes projecting pieces. The projecting pieces project along the axial direction of the inner core portions 31 and 32 from the inner peripheral edges of the through-holes on the surface of the frame plate on the winding portion 21 and 22 side. The projecting pieces project between the inner peripheral faces of the winding portions 21 and 22 and the outer peripheral faces of the inner core portions 31 and 32. The projecting pieces maintain a gap between the winding portions 21 and 22 and the inner core portions 31 and 32, thus improving the electrical insulation therebetween. The respective portions are also positioned by the projecting pieces.

The peripheral wall 43 of each holding member 4 surrounds the outer peripheral faces of one of the outer core portions 33, and positions that outer core portion 33 relative to the holding member 4. In the present embodiment, the peripheral wall 43 is a continuous rectangular frame-shaped wall that covers the outer peripheral faces of the outer core portion 33, that is to say the faces that oppose the inner peripheral surface 520 of the side wall portion 52 of the case 5 (FIG. 1).

Note that the shape, size, and the like of the holding members 4 can be changed as appropriate. The holding members 4 may have a known configuration.

The constituent material of the holding members 4 is an electrical insulating material such as a resin, for example. Examples of the resin include a thermoplastic resin and a thermosetting resin. See the description of the composite material compact in the "Magnetic core" section for specific examples of a thermoplastic resin and a thermosetting resin. The holding members 4 can be manufactured using a known molding method such as injection molding.

2.4. Resin Molded Portion

The reactor 1 may include a resin molded portion 8 that covers at least a portion of the magnetic core 3. The resin molded portion 8 improves electrical insulation between the magnetic core 3 and the coil 2 or peripheral components of the reactor 1, and also protects the magnetic core 3 from the outside environment and provides mechanical protection, for example.

In the present embodiment, if the resin molded portion 8 covers the magnetic core 3 but exposes the outer peripheral faces of the winding portions 21 and 22 rather than covering them, the resin molded portion 8 has excellent heat dissipation performance. This is because the outer peripheral faces of the winding portions 21 and 22 can be arranged close to the inner peripheral surface 520 of the case 5. Note that the resin molded portion 8 may cover both the coil 2 and the magnetic core 3.

The covering region, thickness, and the like of the resin molded portion 8 can be selected as appropriate.

In the present embodiment, the resin molded portion 8 includes inner resin portions 81 and 82 and outer resin portions 83. The inner resin portions 81 and 82 respectively cover at least a portion of the inner core portions 31 and 32. The outer resin portions 83 respectively cover at least a portion of the outer core portions 33. In the present embodiment, the inner resin portions 81 and 82 and the outer resin portions 83 are a continuous single-piece molded member. This resin molded portion 8 holds the core pieces as an integrated member, and improves the strength and rigidity of the magnetic core 3 as a monolithic object.

Alternatively, a configuration is possible in which the resin molded portion 8 does not include the inner resin portions 81 and 82, and covers substantially only the outer core portions 33, for example.

Various types of resin can be used as the constituent material of the resin molded portion 8. One example is a thermoplastic resin. See the description of the composite material compact in the "Magnetic core" section for specific examples of a thermoplastic resin. In addition to a resin, the constituent material may also contain a powder made of a non-metallic inorganic material such as the material described in the "Sealing resin" section that comes later. In the case of containing such a powder, the resin molded portion 8 has excellent heat dissipation performance. The resin molded portion 8 can be molded using a known molding method such as injection molding.

3. Case

The case 5 stores substantially the entirety of the assembly 10, and protects the assembly 10 from the outside environment and provides mechanical protection, for example. In the present embodiment, the case 5 is a made of a metal, and also functions as a heat dissipation path for the assembly 10.

The case 5 is shaped as a bottomed tube that includes the bottom portion 51 and the side wall portion 52. The side of the case 5 opposite to the bottom portion 51 (i.e., the upper side in FIG. 2) is open. The bottom portion 51 is a flat plate-shaped member. The side wall portion 52 is a frame-shaped member that rises upward from the peripheral edge of the bottom portion 51 and is continuous the peripheral edge. The bottom portion 51 and the side wall portion 52 constitute an interior space having a shape and size that allows the assembly 10 and the insertion member 7 to be stored therein.

In the present embodiment, the case 5 is a cuboid container, and has a cuboid interior space that substantially corresponds to the shape of the opening portion. The opening portion is rectangular in a plan view in the depth direction of the case 5 (FIG. 1). Specifically, out of the four corner portions of the rectangular shape, the corner portions on one end side in the lengthwise direction are rounded, whereas the corner portions on the other end side are angled corners (FIG. 1). Note that the lengthwise direction of the rectangular shape is the left-right direction in FIG. 1, and the one end side in the lengthwise direction is the left side. The widthwise direction of the rectangular shape is the up-down direction in FIG. 1.

The side wall portion 52 is shaped as a quadrangular tube. The inner peripheral surface 520 of the side wall portion 52 has a first face 521 and a second face 522 that oppose each other, and a third face 523 and a fourth face 524 that oppose each other (FIG. 1). The first face 521 and the second face 522 are respectively located on the two sides in the lengthwise direction described above. The third face 523 and the fourth face 524 are respectively located on the two sides in the widthwise direction described above. The second to fourth faces 522 to 524 are all flat surfaces. The first face 521 includes curved faces at the connection with the third face 523 and the connection with the fourth face 524, and is flat at the other locations.

The size of the interior space of the case 5 is adjusted such that sealing resin portion 6 has a predetermined size in the case 5 when the assembly 10 and the insertion member 7 are stored therein. Here, the space formed between the case 5 and the assembly 10 and insertion member 7 includes a first region 561 that is provided between the bottom portion 51 of the case 5 and the leading end portion 70 of the insertion member 7, and a second region 562 that is the region other than the first region 561. The first region 561 and the second region 562 are shown as virtual regions in FIG. 2 and the like. The first region 561 and at least a portion of the second region 562 are filled by the sealing resin portion 6. The size of the interior space of the case 5 is adjusted according to the size of the assembly 10 and the insertion member 7 such that the sealing resin portion 6 that fills the first region 561 and the second region 562 has a predetermined size.

The first region 561 is a region that is mainly surrounded by the inner bottom face of the bottom portion 51 of the case 5, the inner peripheral surface 520 of the case 5, the outer peripheral surface 100 of the assembly 10, and an end face 71 of the leading end portion 70 of the insertion member 7. In the present embodiment, the first region 561 is provided at a location that is on the one end side in the lengthwise direction and on the bottom portion 51 in the case 5. For this reason, the portion of the inner peripheral surface 520 that constitutes the first region 561 is the first face 521 that is located on the one end side in the lengthwise direction. Also, the portion of the outer peripheral surface 100 that constitutes the first region 561 is the outer peripheral face of the peripheral wall 43 of the holding member 4 disposed on the bottom portion 51 side, which is the face that opposes the first face 521 (the left surface in FIG. 2).

In the first region 561, a height H6 from the inner bottom face of the bottom portion 51 of the case 5 to the end face 71 of the leading end portion 70 of the insertion member 7 corresponds to the height of the first resin portion 61 of the sealing resin portion 6 that fills the first region 561. The height H6 is the length along the depth direction of the case 5.

In the present embodiment, the second region 562 is a region that is mainly surrounded by the inner bottom face of the bottom portion 51 of the case 5, the inner peripheral surface 520 of the case 5, and the outer peripheral surface 100 of the assembly 10, and is the region other than the first region 561. In the present embodiment, the portions of the inner peripheral surface 520 that constitute the second region 562 are the second to fourth faces 522 to 524. Also, the portion of the outer peripheral surface 100 of the assembly 10 that constitutes the second region 562 is the face of the outer peripheral face 100 that opposes the first face 521, that is to say the portion other than the left face in FIG. 2.

In the second region 562, the gap between the outer peripheral surface 100 of the assembly 10 and the inner peripheral surface 520 of the case 5 (here, the second to fourth faces 522 to 524) corresponds to a thickness t6 of a later-described second resin portion 62 of the sealing resin portion 6 that surrounds the outer peripheral surface 100 of the assembly 10. As shown in FIG. 1, the thickness t6 is the length along the lengthwise direction of the case 5, or the length along the widthwise direction.

In the interior space of the case 5, a length L5 along the lengthwise direction is substantially equivalent to the sum of a length L10, a length L7, and the thickness t6. The length L10 is the length of the assembly 10 along the lengthwise direction. The length L7 is the maximum distance from the outer peripheral surface 100 of the assembly 10 (here, the outer peripheral face of the peripheral wall 43 of the holding member 4) to the first face 521.

Figure 3:
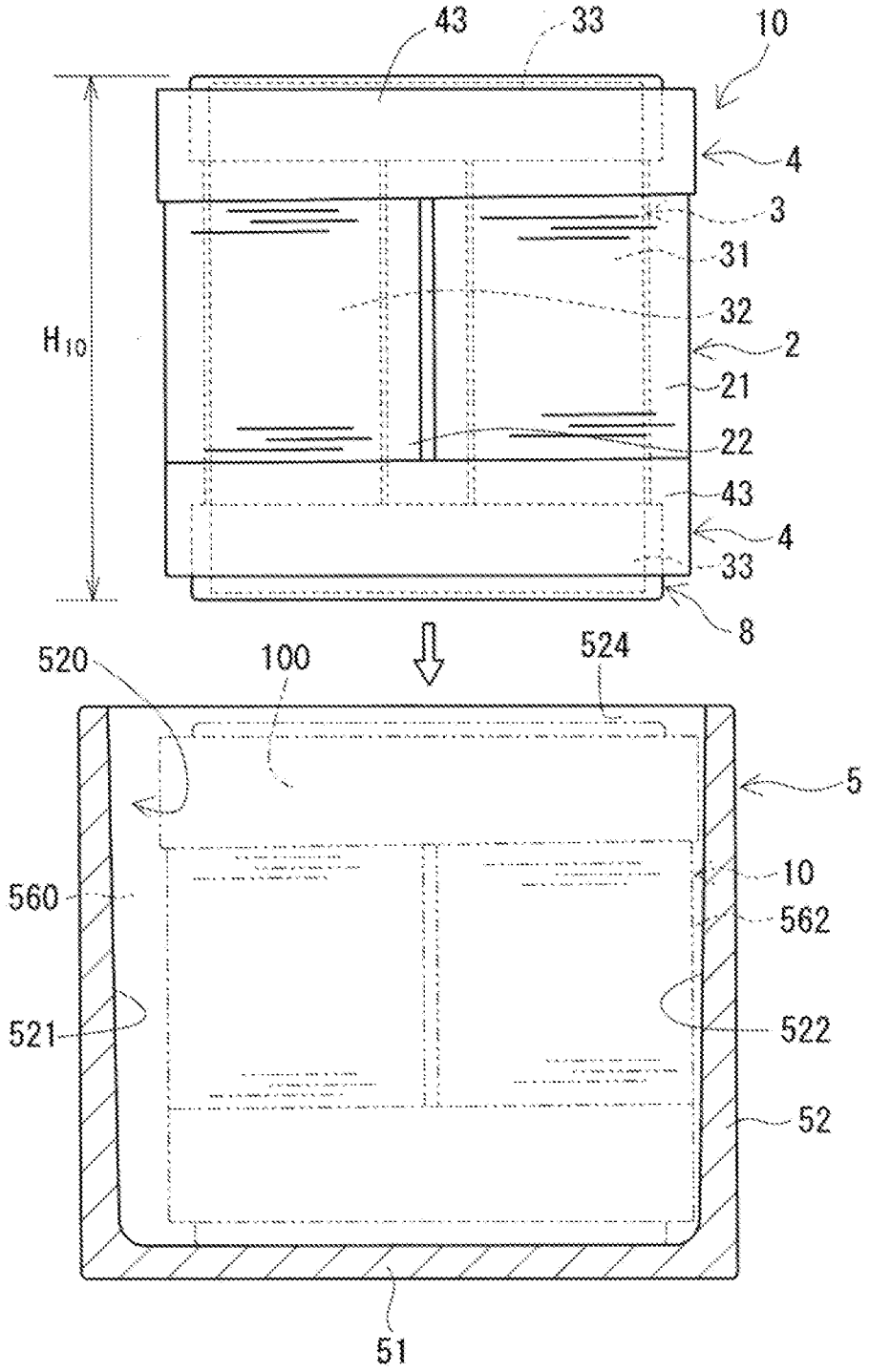
FIG. 3 is a diagram illustrating a step for manufacturing the reactor of the first embodiment, and shows a state in which the assembly is stored in the case.

A depth H5 of the case 5 is greater than or equal to a height H10 of the assembly 10 along the axial direction of the winding portions 21 and 22 (FIG. 3). In the present embodiment, the depth H5 is slightly larger than the height H10.

In the present embodiment, the case 5 is a metallic box in which the bottom portion 51 and the side wall portion 52 are molded integrally. In particular, if the metal that forms the case 5 is an aluminum-based material as in the present embodiment, the case 5 has excellent heat dissipation performance and is lightweight, and there is also an effect of making it unlikely for the case 5 to have a magnetic influence on the coil 2 because aluminum is a non-magnetic material. The aluminum-based material may be pure aluminum or an aluminum-based alloy.

4. Sealing Resin

The sealing resin portion 6 fills at least a portion of the space formed between the case 5 and the assembly 10 and insertion member 7. Also, the sealing resin portion 6 covers at least a portion of the assembly 10 in the case 5 and is in contact with at least a portion of the insertion member 7. The sealing resin portion 6 has functions such as protecting the assembly 10 from the outside environment, providing mechanical protection, and improving electrical insulation between the assembly 10 and the case 5, as well as integrating the assembly 10 and the case 5 and improving heat dissipation performance.

In the present embodiment, the sealing resin portion 6 fills substantially the entirety of the space described above. In other words, substantially the entirety of the assembly 10 and substantially the entirety of the insertion member 7 are embedded in the sealing resin portion 6.

The constituent material of the sealing resin portion 6 is any of various types of resins, for example. One example is a thermosetting resin. Examples of a thermosetting resin include silicone resin, epoxy resin, urethane resin, and unsaturated polyester resin. If silicone is the main material, the sealing resin portion 6 has excellent heat resistance and heat dissipation performance. Note that the silicone resin may be in gel form. If epoxy resin is the main material, the sealing resin portion 6 has a high modulus of elasticity and can firmly fix the assembly 10 to the case 5. Alternatively, the resin may be a thermoplastic resin such as PPS resin, for example.

The constituent material of the sealing resin portion 6 may contain any of the above-described resins and a powder made of a non-metallic inorganic material. Examples of the non-metallic inorganic material include a ceramic and a carbon-based material. Examples of a ceramic include alumina and silica. Such a non-metallic inorganic material has better thermal conductance than a resin. Accordingly, if the sealing resin portion 6 contains a powder made of a non-metallic inorganic material, particularly a powder made of a non-metallic inorganic material having a high thermal conductivity, heat generated by the assembly 10 is favorably transmitted to the case 5. For example, the thermal conductivity of the sealing resin portion 6 is 1 W/m·K or higher, or preferably 1.5 W/m·K or higher. In the case of containing a powder made of a ceramic, the sealing resin portion 6 has even higher electrical insulation performance. Alternatively, a known resin compound may be used as the constituent material of the sealing resin portion 6.

5. Insertion Member

5.1. Overview

The insertion member 7 is a member that is independent of the assembly 10, the case 5, and the sealing resin portion 6. Note that the insertion member 7 is stored side-by-side with the assembly 10 in the case 5. Typically, the insertion member 7 is a column-shaped or bar-shaped member whose length H7 is less than the depth H5 of the case 5, and is stored extending along the depth direction of the case 5 in the case 5 as in the present embodiment.

Also, when stored in the case 5, at least a portion of the insertion member 7 is in contact with the sealing resin portion 6. Specifically, a leading end portion 70 of the insertion member 7, which is disposed on the bottom portion 51 side of the case 5, is in contact with the first resin bottom portion 61 of the sealing resin portion 6 that fills the bottom portion 51 side. It can be said that the insertion member 7 having the leading end portion 70 was in contact with the raw resin 600 of the sealing resin portion 6 that fills the bottom portion 51 of the case 5 during the process of manufacturing the reactor 1.

Also, in the present embodiment, a different portion of the insertion member 7 is in contact with the outer peripheral surface 100 of the assembly 10. Also, yet another portion of the insertion member 7 is in contact with a portion of the inner peripheral surface 520 of the case 5. Specifically, the end portion of the insertion member 7 on the side opposite to the leading end portion 70, that is to say the open side of the case 5, includes a portion that is in contact with the outer peripheral surface of the peripheral wall 43 of the holding member 4 disposed on the open side of the case 5, and a portion that is in contact with the first face 521 of the case 5. In other words, this end portion of the insertion member 7 is sandwiched between the peripheral wall 43 of the assembly 10 and the first face 521 of the case 5.

In the present embodiment, the insertion member 7 is a column-shaped body made of one material (here, a rubber material). Also, in the present embodiment, the insertion member 7 is a solid body having a uniform shape and uniform size in the axial direction with respect to the cross-sectional shape and the cross-sectional area along a plane orthogonal to the axial direction of the insertion member 7.

5.2. Constituent Material Hardness

The constituent material of the insertion member 7 has a type A durometer hardness of 50 or higher. If the type A durometer hardness is 50 or higher, it can be said that the insertion member 7 has a hardness sufficient for pressing even if the raw resin 600 is highly viscous during the process of manufacturing the reactor 1. The higher the type A durometer hardness is, the higher the rigidity of the insertion member 7 is, and the more easily the insertion member 7 can press the raw resin 600. In view of this, the type A durometer hardness may be 60 or higher, or 70 or higher.

The hardness of the constituent material of the insertion member 7 may be a hardness that exceeds the type A durometer hardness measurement range, such as a type D durometer hardness. For example, the type D durometer hardness of the constituent material may be 80 or higher, or 100 or higher. Also, the hardness of the constituent material may be a hardness that can be measured as a Vickers hardness. For example, the Vickers hardness of the constituent material may be 50 or higher, or 80 or higher. Note that all of the hardnesses described above may be measured using a commercially available measurement device.

Also, the type A durometer hardness may be 90 or lower, or further 85 or lower. In this case, the insertion member 7 has an excellent elastic deformation characteristic. For this reason, even if the size of the insertion member 7 when not undergoing elastic deformation is larger than the size of the space for storing the insertion member 7 in the case 5, the insertion member 7 can undergo elastic deformation so as to be disposed in the storage space. In other words, the insertion member 7 can easily conform to the shape of the storage space.

5.3. Constituent Material Composition

The constituent material of the insertion member 7 may be an electrically insulating material or an electrically conductive material, as long as the above-described hardness is achieved. It is preferable that the constituent material of at least the surface layer of the insertion member 7 that is adjacent to the coil 2, the magnetic core 3, and the case 5 is an electrically insulating material. This is because the electrical insulation performance between the insertion member 7 and the coil 2 and the like can be excellent.

Examples of the electrically insulating material include a resin, a rubber material, and a ceramic. Examples of the electrically conductive material include a metal and a carbon-based material. Alternatively, the constituent material may be a mixture that contains an electrically insulating material and an electrically conductive material.

If the constituent material of the insertion member 7 is a resin or a rubber material, the electrical insulation between the insertion member 7 and the coil 2, magnetic core 3, and case 5 is improved. Also, in this case, the insertion member 7 is lighter than in the case where the constituent material includes a metal. In addition to a resin or a rubber material, the constituent material may also contain a powder made of a non-metallic inorganic material such as the material described in the above-described "Sealing resin" section. In this case, the insertion member 7 has excellent thermal conductance and can easily transmit heat generated by the assembly 10 to the case 5, as described above.

5.3.1. Resin

Specific examples of the resin include a thermoplastic resin and a thermosetting resin. See the description of the composite material compact in the "Magnetic core" section for specific examples of a thermoplastic resin and a thermosetting resin. Resin materials generally have a higher rigidity than rubber materials. For this reason, if the constituent material of the insertion member 7 is a resin, the insertion member 7 can more easily press the raw resin 600 in the process of manufacturing the reactor 1 than in the case where the constituent material is a rubber. Note that some resins have a type D durometer hardness or a Vickers hardness.

In the case where the constituent material of the insertion member 7 contains a resin, that resin may be the same as the resin that constitutes the sealing resin portion 6. In this case, there is substantially no difference between the thermal expansion coefficients of the insertion member 7 and the sealing resin portion 6. This therefore makes it possible to prevent the formation of cracks or the like caused by thermal expansion in at least either the insertion member 7 or the sealing resin portion 6. Note that the resin in the insertion member 7 and the resin in the sealing resin portion 6 may be different from each other.

If the constituent material of the insertion member 7 contains a resin, and a portion of the assembly 10 (in the present embodiment, the holding member 4) that comes into contact with the insertion member 7 contains a resin, the resin in the insertion member 7 may be the same as the resin in the holding member 4. In this case, there is substantially no difference between the thermal expansion coefficients of the insertion member 7 and the holding member 4. This therefore makes it possible to prevent the formation of cracks or the like caused by thermal expansion in at least either the insertion member 7 or the holding member 4. Note that the resin in the insertion member 7 and the resin in the holding member 4 may be different from each other. Also, even if the portion of the assembly 10 that comes into contact with the insertion member 7 is the resin molded portion 8, the same as the holding member 4 applies.

5.3.2. Rubber

Specific examples of a rubber material include natural rubber, isoprene rubber, styrene-butadiene rubber, and butadiene rubber. In particular, a rubber material having a type A durometer hardness of 90 or lower has an excellent elastic deformation characteristic. If the insertion member 7 is made of a rubber material having an excellent elastic deformation characteristic, the above-described freedom with respect to size is favorable. Note that the constituent material of the insertion member 7 may be a rubber material having a type D durometer hardness.

5.3.3. Ceramic

See the previous "sealing resin" section for specific examples of ceramics. Note that ceramics, the later-described metals, and carbon-based materials generally have a Vickers hardness.

5.3.4. Electrically Conductive Material

In the case where the constituent material of the insertion member 7 contains an electrically conductive material, a metal or a carbon-based material generally have a better thermal conductance than a resin or a rubber material. For this reason, in the case where the constituent material contains a metal, a carbon-based material, or the like, the insertion member 7 favorably transmits heat generated by the assembly 10 to the case 5 and contributes to an improvement in heat dissipation performance.

5.3.5. Other Aspects

Figure 6:
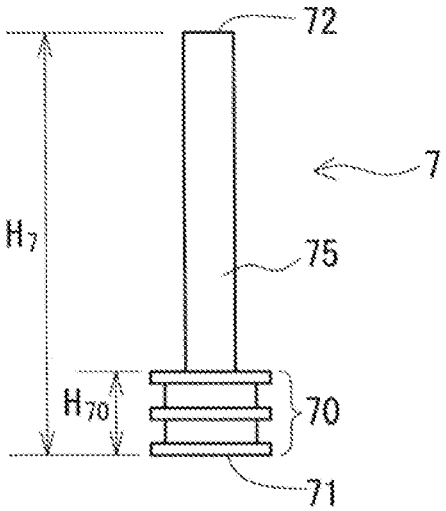
FIG. 6 is a front view of another example of the insertion member provided in the reactor of the first embodiment.

The constituent material of the insertion member 7 may be a single material or multiple materials. That is to say, the insertion member 7 may include a combination of different materials. In the case of being made of a single material as in the present embodiment, the insertion member 7 can be molded easily, thus achieving excellent manufacturability. If the insertion member 7 includes a combination of materials, it can have characteristics that correspond to the included materials. As one specific example, the insertion member 7 may include a leading end portion 70 made of a rubber material and a shaft portion 75 made of a resin, as described in Variation 1(1) described later (FIG. 6). Alternatively, although not shown, an aspect is possible in which the insertion member 7 includes a core portion made of a metal and a surface layer made of an electrically insulating material.

5.4. Structure

In the present embodiment, the insertion member 7 is a single-piece molded member. In this case, the insertion member 7 is excellent in terms of manufacturability. Alternatively, the insertion member 7 may be combination of multiple members, as described in Variation 1(1) described later.

In the present embodiment, the insertion member 7 includes two end faces 71 and 72 that oppose each other and an outer peripheral surface that connects the end faces 71 and 72, and is a cuboid when not undergoing elastic deformation. In the present embodiment, the end faces 71 and 72 are flat surfaces. The outer peripheral surface includes flat faces and curved faces. When the insertion member 7 is stored in the case 5, the end face 71 and surrounding region disposed on the bottom portion 51 side of the case 5 constitute the leading end portion 70 of the insertion member 7. In other words, the leading end portion 70 includes the end face 71 that comes into contact with a portion of the sealing resin portion 6 (here, the first resin portion 61).

5.5. Shape

In the present embodiment, in the state where the assembly 10 is stored in the case 5 but the insertion member 7 is not stored therein, the insertion member 7 has a shape that basically corresponds to the shape of a column-shaped space 560 (FIGS. 1 and 3) provided on the one end side of the case 5 in the lengthwise direction. Specifically, the planar shape of the end faces 71 and 72 is basically similar to the planar shape of the space 560, and two of the four corner portions of the rectangular shape are rounded corner portions (FIG. 1). Note that if the constituent material of the insertion member 7 is a material having an excellent elastic deformation characteristic as in the present embodiment, the planar shape of the end faces 71 and 72 may be a shape that is not similar to the planar shape of the space 560, such as being a completely rectangular shape or a circular shape, for example.

The planar shape of the end faces 71 and 72 is the shape thereof in a plan view along the axial direction of the insertion member 7. The axial direction of the insertion member 7 is basically the same as the depth direction of the case 5 when the insertion member 7 is stored in the case 5. The planar shape of the space 560 is the shape thereof in a plan view along the depth direction of the case 5. In the present embodiment, the planar shape of the space 560 is mainly constituted by the first face 521 that is located on the one end side of the case 5 in the lengthwise direction, and the face of the outer peripheral surface 100 of the assembly 10 that is an outer peripheral face of the peripheral wall 43 of the holding member 4 and opposes the first face 521.

In the present embodiment, the outer peripheral surface of the insertion member 7 includes two curved faces that correspond to the roundedness of the above-described corner portions, and two side faces 701 and 705 that oppose each other. The side faces 701 and 705 are both flat surfaces. The shape formed by the side face 705 and the two curved faces basically corresponds to the shape of the first face 521 of the case 5. The side face 701 is disposed so as to oppose the outer peripheral face of the peripheral wall 43 of the holding member 4 of the assembly 10 disposed on the open side of the case 5.

5.6. Size

It is preferable that the size of the insertion member 7 corresponds to the size of the space 560 on the one end side in the case 5. One reason for this is that the volume of the insertion member 7 is likely to be larger, the filler amount of the sealing resin portion 6 (i.e., the filler amount of the raw resin 600) is likely to be smaller, and moreover the insertion member 7 can reliably press the raw resin 600. Another reason is that the insertion member 7 can prevent the shifting of the position of the assembly 10 in the case 5.

For example, if the insertion member 7 is a column-shaped body as in the present embodiment, a maximum area S7max (including the area of the cross-section along a plane orthogonal to the axial direction of the insertion member 7, and the areas of the end faces 71 and 72) is greater than or equal to 70% of a plane area Smax of the space 560. The plane area Smax of the space 560 is the maximum plane area at the location in the space 560 where the insertion member 7 is disposed. As one representative example, the plane area Smax is the maximum plane area of the first region 561 described later. It is preferable that the plane area Smax is greater than the cross-sectional area of a later-described nozzle 9 (FIGS. 4A and 4B). The reason for this is that the nozzle 9 can be inserted into the space 560.

The higher the area S7max of the insertion member 7 is, the larger the volume of the insertion member 7 is likely to be. For this reason, the filler amount of the sealing resin portion 6 is likely to decrease. Therefore, the area S7max of the insertion member 7 may be greater than or equal to 75%, greater than or equal to 80%, greater than or equal to 90%, or greater than or equal to 95% of the plane area Smax of the space 560.

The upper limit of the area S7max of the insertion member 7 can be appropriately selected in accordance with the constituent material of the insertion member 7. From the viewpoint of allowing the insertion of the insertion member 7 into the space 560, the upper limit of the area S7max is less than 100% of the plane area Smax of the space 560, for example. If the constituent material of the insertion member 7 is a material having a low elastic deformation characteristic such as a ceramic, the upper limit of the area S7max is less than 100% of the plane area Smax of the space 560, for example.

If the constituent material of the insertion member 7 is a material that easily undergoes elastic deformation, such as a rubber material, the upper limit of the area S7max may be greater than or equal to 100% of the plane area Smax of the space 560 when the insertion member 7 is not undergoing elastic deformation. The reason for this is that when the insertion member 7 is disposed in the space 560, the portion of the insertion member 7 that has the area S7max undergoes elastic deformation such that the insertion member 7 can be inserted into a portion of the space 560 where the plane area is less than or equal to the plane area Smax. Depending on the rubber material or the like, the area S7max may be greater than or equal to 105%, greater than or equal to 108%, or greater than or equal to 110% of the plane area Smax of the space 560. The larger the area S7max is, the smaller the filler amount of the sealing resin portion 6 is likely to be. However, if the area S7max is too large, the friction force is too high when the insertion member 7 is disposed in the space 560, thus making it difficult to insert the insertion member 7. The assembly 10 or the case 5 can conceivably become scratched due to friction. For this reason, the area S7max of the end face 71 is less than or equal to 130% of the plane area Smax of the space 560.

In the present embodiment, the constituent material of the leading end portion 70 is a rubber material, and the area S7 of the end faces 71 and 72 is greater than or equal to 100% of the plane area Smax of the space 560 when the leading end portion 70 is not undergoing elastic deformation. Because the volume of the leading end portion 70 is high, the insertion member 7 of the present embodiment is even more likely to reduce the filler amount of the sealing resin portion 6. Also, the raw resin 600 that has been pressed by the elastically deformed leading end portion 70 is likely to flow from the insertion member 7 side to the assembly 10 side, and from the bottom portion 51 side of the case 5 to the open side. In other words, the raw resin 600 is likely to flow to the second region 562. In particular, even if the second region 562 has a narrow portion, the pressed raw resin 600 is likely to enter that narrow portion. The reason for this is that due to the elastically deformed leading end portion 70 the raw resin 600 that fills the space 560 that has the plane area Smax and the vicinity thereof is in a nearly liquid-tight state. The larger the area S7 is, the smaller the filler amount of the raw resin 600 is likely to be, and the easier it is to create the aforementioned liquid-tight state. For this reason, the area S7 may be greater than or equal to 105%, greater than or equal to 108%, or greater than or equal to 110% of the plane area Smax of the space 560. Also, from the viewpoint of reducing friction as described above, the area S7 may be less than or equal to 130% of the plane area Smax of the space 560.

Note that when the insertion member 7 of the present embodiment and the assembly 10 are stored in the case 5, the first region 561 of the space 560 on the bottom portion 51 side of the case 5 is filled by the elastically deformed leading end portion 70. Also, due to undergoing elastic deformation, the leading end portion 70 is in close contact with the first face 521 of the case 5 and the holding member 4 on the bottom portion 51 side.

In the present embodiment, the area S7 of the end faces 71 and 72 is greater than or equal to the plane area of the region of the space 560 that is in the vicinity of the holding member 4 disposed on the open side of the case 5. For this reason, when the assembly 10 and the insertion member 7 are stored in the case 5, the region of the space 560 on the open side is filled by the elastically deformed insertion member 7. Also, due to undergoing elastic deformation, the end portion of the insertion member 7 on the side opposite to the leading end portion 70 is in close contact with the first face 521 of the case 5 and the holding member 4 (FIG. 1). This insertion member 7 functions as a member for positioning the assembly 10 in the case 5.

Also, the length H7 of the insertion member 7 in the axial direction is greater than or equal to 40% of the depth H5 of the case 5, for example. If the length H7 is greater than or equal to 40% of the depth H5, the volume of the insertion member 7 is likely to be larger. The length H7 can be selected in a range of less than 100% of the depth H5 of the case 5. The longer the length H7 of the insertion member 7 is, the larger the volume of the insertion member 7 is likely to be. For this reason, the length H7 may be greater than or equal to 45%, greater than or equal to 50%, greater than or equal to 55%, or greater than or equal to 60% of the depth H5. In particular, if the area S7 of the end faces 71 and 72 is greater than or equal to the plane area Smax and the length H7 is greater than or equal to 40% of the depth H5, the volume of the insertion member 7 is larger, which is preferable.

The length H7 of the insertion member 7 may be less than or equal to 90%, less than or equal to 85%, or less than or equal to 80% of the depth H5 of the case 5. In this case, it is possible to prevent an excessive decrease in the filler amount of the raw resin 600, that is to say the filler amount of the sealing resin portion 6. If the length H7 is less than or equal to 90% of the depth H5 of the case 5, when the insertion member 7 is stored in the case 5, a gap that is greater than or equal to 10% of the depth H5 is ensured between the end face 71 and the inner bottom face of the bottom portion 51 of the case 5. In this case, the reactor 1 includes the first resin portion 61 that has a height H6 that is greater than or equal to 10% of the depth H5.

In the present embodiment, the length H7 of the insertion member 7 is greater than or equal to 40% and less than or equal to 80% of the depth H5 of the case 5. For this reason, when the insertion member 7 is stored in the case 5, the insertion member 7 does not protrude from the opening of the case 5. Also, the length H7 of the insertion member 7 is shorter than the length H10 of the assembly 10.

Note that the constituent material, the shape, the structure, the size, and the like of the insertion member 7 can be changed as appropriate. See later-described Variation 1 as an example of this.

6. Storage in Case

In the present embodiment, the assembly 10 is stored in the case 5 such that the axial direction of the winding portions 21 and 22 is parallel with the depth direction of the case 5. The insertion member 7 is stored in the case 5 such that the axial direction of the insertion member 7 is parallel with the depth direction of the case 5. Also, the assembly 10 and the insertion member 7 case 5 are stored side-by-side in the lengthwise direction of the case 5. Specifically, the assembly 10 is arranged on one end side in the lengthwise direction, which is the right side in FIG. 2. The insertion member 7 is arranged on the other end side in the lengthwise direction, which is the left side in FIG. 2.

In the present embodiment, the end face 71 of the insertion member 7 is disposed so as to oppose the inner bottom face of the bottom portion 51 of the case 5 while being separated by a certain distance from the inner bottom face. The gap between the end face 71 and the inner bottom face is greater than or equal to 20% of the depth H5 of the case 5 and less than or equal to (depth H5−length H7). The first resin portion 61, which is a portion of the sealing resin portion 6, fills the gap between the end face 71 and the inner bottom face. The end face 72 of the insertion member 7 is covered by the second resin portion 62, which is another portion of the sealing resin portion 6.

In the present embodiment, the side face 705 and the curved face of the outer peripheral surface of the insertion member 7 are substantially entirely in contact with the first face 521 of the inner peripheral surface 520 of the case 5. Also, a portion of the side face 701 of the outer peripheral face of the insertion member 7 is in contact with the outer peripheral faces of the peripheral walls 43 of the holding members 4, which are part of the outer peripheral surface 100 of the assembly 10. In other words, the region of the space 560 other than the first region 561 is substantially filled by the insertion member 7, and the gap between the side face 705 and the assembly 10, here the gap between the side face 705 and the outer peripheral faces of the winding portions 22, is filled by a portion of the sealing resin portion 6.

Note that the storage state of the assembly 10 in the case 5 can be changed as appropriate. See later-described Variation 4 as an example of this.

7. Sealing Resin Portion

The sealing resin portion 6 includes the first resin portion 61 and the second resin portion 62. The first resin portion 61 and the second resin portion 62 are a continuous monolithic body.

The first resin portion 61 fills the first region 561 of the space 560 in the case 5. In the present embodiment, the first resin portion 61 is in surface contact with the end face 71 of the insertion member 7.

The size of the first resin portion 61 corresponds to the size of the first region 561. Specifically, the first resin portion 61 has the above-described plane area Smax and height H6. Also, the size of the first resin portion 61 in the direction orthogonal to the depth direction of the case 5 (here, the size along the lengthwise direction of the case 5) substantially corresponds to the length L7.

The second resin portion 62 fills at least a portion of the second region 562. It is preferable that the second resin portion 62 covers at least the winding portions 21 and 22 of the assembly 10 as in the present embodiment. One reason for this is that the second resin portion 62 provides excellent electrical insulation between the case 5 and the winding portions 21 and 22. Another reason is that heat is favorably transmitted from the winding portions 21 and 22 to the case 5 via the second resin portion 62, thus achieving excellent heat dissipation performance.

In the present embodiment, the second resin portion 62 fills substantially the entirety of the second region 562. Accordingly, the second resin portion 62 includes a portion that covers the outer peripheral surface 100 of the assembly 10 and a portion that covers the face of the assembly 10 on the open side of the case 5 and the end face 72 of the insertion member 7.

The smaller the thickness t6 of the portion of the second resin portion 62 that covers the outer peripheral surface 100 of the assembly 10 is, the smaller the filler amount of the raw resin 600 (i.e., the filler amount of the sealing resin portion 6) is. Also, the winding portions 21 and 22 are closer to the case 5, and therefore the reactor 1 has excellent heat dissipation performance. For example, the thickness t6 is less than or equal to 1.5 mm, less than or equal to 1 mm, or less than or equal to 0.8 mm. The thickness t6 may be greater than or equal to 0.5 mm and less than or equal to 1 mm as in the present embodiment. The larger the thickness t6 is, the more easily the sealing resin portion 6 can fix the assembly 10 to the case 5.

Note that the second resin portion 62 need only cover the winding portions 21 and 22, and may expose portions of the assembly 10 other than the winding portions 21 and 22. For example, the second resin portion 62 may expose a portion of the assembly 10 on the open side of the case 5 (here, a portion that covers the end faces of the holding member 4 and the end faces of the outer core portions 33 of the resin molded portion 8), for example.

8. Reactor Manufacturing Method

The reactor 1 of the above-described embodiment can be manufactured through a reactor manufacturing method that includes the following steps, for example.

First step: prepare the assembly 10, the case 5, and the insertion member 7.

Second step: store the assembly 10 in the case 5.

Third step: introduce the raw resin 600 of the sealing resin portion 6 into the case 5.

Fourth step: press the raw resin 600 in the case 5 with the insertion member 7 while inserting the insertion member 7 into the case 5.

The reactor manufacturing method having the above steps will be described below with reference to mainly FIGS. 3 to 5.

Figure 5:
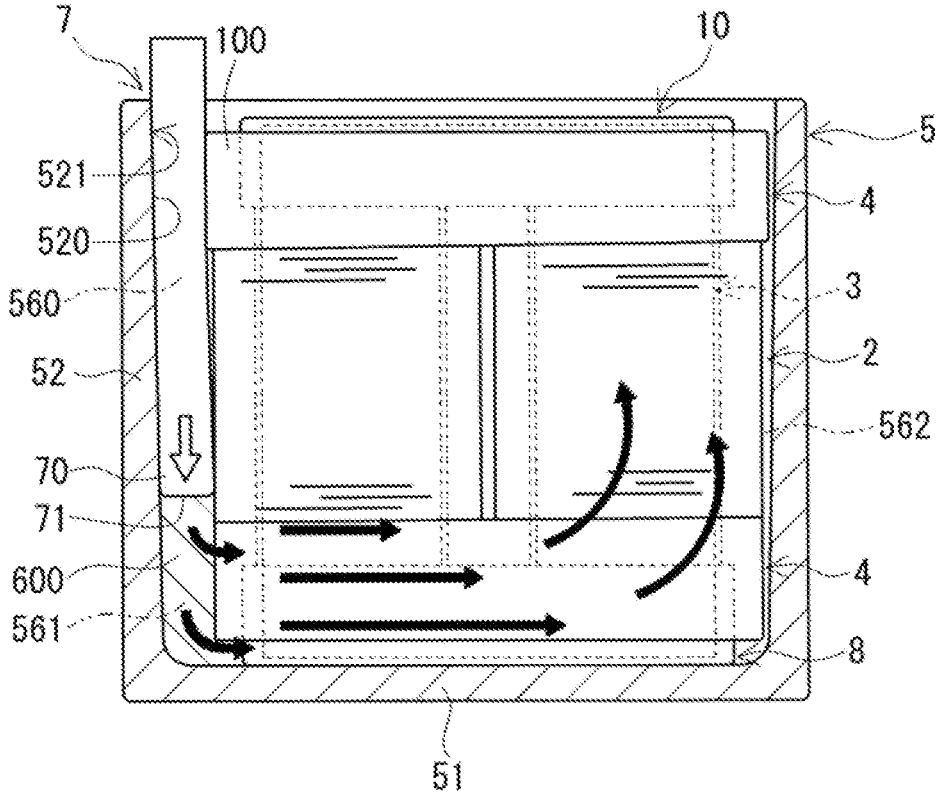
FIG. 5 is a diagram illustrating a step for manufacturing the reactor of the first embodiment, and shows a state in which an insertion member presses raw resin introduced into a first region in the case.

The case 5 shown in FIG. 3 and the case 5 and the raw resin 600 shown in FIGS. 4A and 5 are shown as a cross-section taken along a plane parallel with the depth direction of the case 5.

The assembly 10 and the nozzle 9 in FIG. 4A and the assembly 10 and the insertion member 7 in FIG. 5 are shown in an exterior view rather than in a cross-sectional view.

In the first step, the coil 2, the magnetic core 3, and the holding member 4 of the present embodiment are combined to obtain the assembly 10 (FIG. 3). If the assembly 10 includes the resin molded portion 8 as in the present embodiment, the resin molded portion 8 is also formed. For example, in the state where the coil 2 and the magnetic core 3 are positioned by the holding members 4, at least a portion of the assembly 10 is covered with uncured resin serving as the raw material of the resin molded portion 8, and then the resin is allowed to cure.

The resin molded portion 8 of the present embodiment is manufactured as described below, for example. The size of the peripheral walls 43 is adjusted such that gaps are provided between the inner peripheral faces of the peripheral walls 43 of the holding members 4 and the outer peripheral faces of the outer core portions 33. The space continuous with these gaps, the through-holes of the holding members 4, and the gaps between the winding portions 21 and 22 and the inner core portions 31 and 32 is filled with the resin for forming the resin molded portion 8, and then the resin is allowed to cure.

In the second step, the assembly 10 is stored in the case 5 such that the assembly 10 is in a predetermined storage state. In the present embodiment, as virtually shown using dashed double-dotted lines in FIG. 3, the assembly 10 is stored in the case 5 on the other end side of the case 5 in the lengthwise direction, that is to say the left side in FIG. 3. As a result, before the insertion member 7 is inserted, the case 5 storing the assembly 10 has the space 560 on the one end side in the lengthwise direction (the left side in FIG. 3), that is to say a space formed between the first face 521 and the face that opposes the first face 521 on the outer peripheral surface 100 of the assembly 10. The space 560 is used as the region to be filled with the raw resin 600 (see FIG. 4A) and the region for storage of the insertion member 7 (see FIG. 5). Note that the region other than the space 560 in the space in the case 5 storing the assembly 10 is the second region 562.

In the third step, a nozzle 9 is inserted into the space 560 in the case 5, and the nozzle 9 is used to fill the space 560 with the raw resin 600 (FIG. 4A). The filling is stopped when the surface of the raw resin 600 reaches a predetermined end position in the space 560. The nozzle 9 is then withdrawn from the space 560.

The nozzle 9 can be a cylindrical member having a diameter less than or equal to the length L7 (FIG. 1), for example. The diameter of the nozzle 9 is greater than or equal to 3.5 mm and less than or equal to 5 mm, for example. In this case, the length L7 is greater than or equal to 5 mm and less than or equal to 15 mm, for example.

The leading end of the nozzle 9 is arranged in the vicinity of the bottom portion 51 of the case 5 (FIG. 4A). Accordingly, the raw resin 600 is introduced into the space 560 from the bottom portion 51 toward the open side of the case 5. In the present embodiment, the first face 521 of the case 5 has curved faces, and therefore the cylindrical nozzle 9 can be arranged closer to one curved face of the first face 521 (FIG. 4B). Accordingly, in the case where the raw resin 600 has spread to the second region 562, the merging locations of the raw resin 600 can be set at a distance from the location where the introduction of the raw resin 600 started (here, the arranged location of the nozzle 9). Also, if one-point filling is performed using one nozzle 9 as in the present embodiment, the number of aforementioned merging locations can be reduced. Accordingly, air bubbles are not likely to become trapped in the raw resin 600, and the case where air bubbles remain in the sealing resin portion 6 is likely to be prevented. Note that FIG. 4A shows the state where the nozzle 9 is arranged in the space 560 such that the leading end of the nozzle 9 is located on the lower side in the vertical direction, and the axis of the nozzle 9 conforms to the vertical direction. The opening at the leading end of the nozzle 9 is open toward the inner bottom face of the bottom portion 51 of the case 5.

It is sufficient that the filler amount of the raw resin 600 is set based on the sum of the volume of the first region 561 and the volume of the second region 562. The end position of the surface of the raw resin is set in accordance with the volume of the filler amount and the volume of the space 560. If the end position is a position that is less than or equal to 70% of the depth H5 (FIG. 2), or furthermore less than or equal to 60% of the depth H5, from the bottom portion 51 of the case 5 along the depth direction of the case 5, the filler amount of the raw resin 600 can be reduced. For this reason, if the viscosity of the raw resin 600 is high (e.g. greater than or equal to 9 P·s or furthermore greater than or equal to 10 P·s), the filling time is likely to be shorter. The viscosity of the raw resin 600 is high in the case of, for example, containing a powder made of a non-metallic inorganic material as in the present embodiment.

The introduction of the raw resin 600 is performed by so-called injection. Also, the plane area of the space 560 is sufficiently larger than the diameter of the nozzle 9 (FIG. 1). For this reason, the raw resin 600 ejected from the nozzle 9 substantially spreads in only the space 560, and hardly flows into the second region 562 at all. As a result, when the raw resin 600 is introduced from the nozzle 9 into the space 560, the surface of the raw resin 600 rises in only the space 560.

Note that if the introduction of the raw resin 600 is performed during vacuum drawing in a vacuum chamber, air bubbles are not likely to remain in the sealing resin portion 6.

In the fourth step, the insertion member 7 is inserted into the space 560 from the open side of the case 5 in the space 560 (FIG. 5). Particular, the raw resin 600 is pressed using the insertion member 7 (FIG. 5). Due to this pressing, the raw resin 600 moves toward the second region 562. As the raw resin 600 flows, the surface of the raw resin 600 in the space 560 moves toward the bottom portion 51 of the case 5, that is to say descends. Also, the surface of the raw resin 600 in the second region 562 moves toward the open side, that is to say rises. When the surface of the raw resin 600 in the second region 562 reaches a predetermined position in the case 5, and the end face 71 of the leading end portion 70 of the insertion member 7 is arranged at a predetermined position in the space 560, the pressing is stopped. The predetermined position is obtained by subtracting the volume of the insertion member 7 from the volume of the space 560, and dividing the resulting volume by the plane area of the space 560. After the pressing ends, the region extending from the inner bottom face of the bottom portion 51 of the case 5 to the end face 71 is the first region 561.

Specifically, the insertion member 7 is moved toward the bottom portion 51 of the case 5 in the space 560, and the end face 71 of the leading end portion 70 is brought into contact with the surface of the raw resin 600 (FIG. 5). In the present embodiment, the insertion member 7 has the portion where the area S7 of the end face 71 is greater than or equal to the plane area of the space 560, and therefore the insertion member 7 undergoes elastic deformation while being moved toward the raw resin 600. The insertion member 7 slides against the outer peripheral surface 100 of the assembly 10 and the first face 521 of the case 5 while being inserted toward the bottom portion 51.

When the insertion member 7 comes into contact with the raw resin 600, the insertion member 7 is then further pressed toward the bottom portion 51 of the case 5 as shown by the white arrow in FIG. 5. As shown by the black arrows in FIG. 5, the raw resin 600 is pressed toward the bottom portion 51 of the case 5 and flows from the space 560 toward the second region 562 and furthermore toward the open side of the case 5. Even if the gap between the outer peripheral surface 100 of the assembly 10 and the inner peripheral surface 520 of the case 5 in the second region 562 is narrow, the raw resin 600 can enter the narrow region due to being pressed by the insertion member 7. In other words, due to the space 560 functioning as a cylinder and the insertion member 7 functioning as a piston, the raw resin 600 is pressed into the second region 562 from the space 560.

In the present embodiment, the area S7 of the insertion member 7 is greater than or equal to the plane area Smax of the space 560 as described above, and therefore the region filled with the raw resin 600 in the space 560 is in a nearly liquid-tight state due to the insertion member 7. Due to this as well, the raw resin 600 pressed by the insertion member 7 can easily enter the narrow region in the second region 562. The raw resin 600 can also easily enter the gap between the assembly 10 and the insertion member 7.

In the present embodiment, after the insertion member 7 is pressed into the space 560, the leading end portion 70 is sandwiched between the holding member 4 on the bottom portion 51 side of the case 5 and the first face 521 of the case 5. Also, the end portion on the end face 72 side is sandwiched between the holding member 4 on the open side of the case 5 and the first face 521 of the case 5. As a result, the position of the insertion member 7 inside the case 5 is fixed.

The assembly 10 is covered by the raw resin 600 that flowed into the second region 562. In the present embodiment, the raw resin 600 covers the faces of the assembly 10 and the insertion member 7 on the open side of the case 5 as described above. Note that for at least one of the assembly 10 and the insertion member 7, the face thereof on the open side of the case 5 may be exposed from the raw resin 600.

The raw resin 600 is then allowed to cure, thus forming the sealing resin portion 6. When the raw resin 600 that fills the gap between the bottom portion 51 of the case 5 and the insertion member 7 pressed into the space 560 has cured, the first resin portion 61 is obtained. When the raw resin 600 that fills the second region 562 has cured, the second resin portion 62 is obtained.

9. Application

The reactor 1 of the first embodiment is applicable to a component of a circuit for performing voltage step-up or step-down. For example, the reactor 1 is applicable to a constituent component of any of various converters or power conversion apparatuses, for example. Examples of converters include a vehicular converter and an air conditioner converter. A DC-DC converter is a representative example of a vehicular converter. Examples of vehicles in which such a converter is installed include a hybrid automobile, a plug-in hybrid automobile, an electric automobile, and a fuel cell automobile.

10. Main Effects

The reactor 1 of the first embodiment includes the insertion member 7, thus reducing the filler amount of the sealing resin portion 6 compared to the case of not including the insertion member 7. Also, heat generated by the assembly 10 is transmitted to the case 5 by the sealing resin portion 6, and particularly by the second resin portion 62, and therefore the reactor 1 of the first embodiment has excellent heat dissipation performance.

In the present embodiment, the volume of the insertion member 7 is high as described below, thus reducing the filler amount of the sealing resin portion 6. The insertion member 7 of the present embodiment is shaped as a cuboid, has the length H7 that is greater than or equal to 40% of the depth H5 of the case 5, and has the area S7 that is greater than or equal to the plane area Smax of the space 560, and therefore the volume of the insertion member 7 is approximately equal to the product of the area S7 and the length H7. It can be said that this insertion member 7 has a high volume. Also, in the present embodiment, corner portions of the space 560 are rounded, thus reducing the filler amount compared the case where all of the corners are angled corners.

The reactor 1 of the present embodiment has excellent heat dissipation performance due to the following four points as well.

The regions of the winding portions 21 and 22 that oppose the inner peripheral surface 520 of the case 5 are larger than in the storage aspect of later-described Variation 3.

The space between the inner peripheral surface 520 of the case 5 and the winding portions 21 and 22 is filled by the second resin portion 62, and heat generated by the winding portions 21 and 22 is favorably transmitted to the case 5 by the second resin portion 62.

The sealing resin portion 6 contains a powder made of a non-metallic inorganic material, and thus has excellent thermal conductance.

The gap between the outer peripheral surface 100 of the assembly 10 and the inner peripheral surface 520 of the case 5 is narrow, mainly having the thickness t6 here, in a large portion of the region. Specifically, greater than or equal to 80% of the region around the circumference of the assembly 10 corresponds to the narrow region.

Furthermore, the reactor 1 of the first embodiment has excellent manufacturability given that the filling time for the raw resin 600 for the sealing resin portion 6 can be shorter. This also makes it possible to reduce the manufacturing cost.

The following are three reasons why the filling time is short.

The filler amount of the raw resin 600 can be reduced by an amount corresponding to the volume of the insertion member 7.

The relatively large space 560 is the space that is filled with the raw resin 600.

The raw resin 600 introduced into the space 560 can be pressed by the insertion member 7.

In terms of the size of the space 560, the length L7 of the space 560 of the present embodiment is greater than the size of the gap between the outer peripheral surface 100 of the assembly 10 and the inner peripheral surface 520 of the case 5 in the second region 562, which is the thickness t6 here (t6«L7). For this reason, the filling time is shorter than in the case where the space filled with the raw resin 600 is narrow such as having the thickness t6. Also, in the present embodiment, the nozzle 9 can be arranged in the space 560, and given that the nozzle 9 can be used as well, the filling time can be made shorter. Furthermore, because the leading end of the nozzle 9 can be arranged on the bottom portion 51 side of the case 5, because the nozzle 9 can be biased to the one end side of the case 5 in the lengthwise direction, and because injection is performed at one point, it is possible to effectively prevent the incorporation of air bubbles. As a result, the filling time, including the deaeration time, can be made shorter.

When pressing is performed, in the present embodiment, even if the second region 562 has a narrow region with a thickness of 1 mm or less, the pressed raw resin 600 can enter the narrow region. Also, in the present embodiment, even if the raw resin 600 has a high viscosity due to containing a powder made of a non-metallic inorganic material, the pressed raw resin 600 can enter the narrow region. Furthermore, in the present embodiment, the constituent material of the leading end portion 70 is a rubber material, and the area S7 is greater than or equal to the plane area Smax, thus making it possible to obtain the liquid-tight state described above, and therefore the insertion member 7 can reliably apply pressing force to the raw resin 600. In view of these points as well, the pressed raw resin 600 can enter the narrow region.

The reactor 1 of the present embodiment has excellent manufacturability due to the following three points as well.

The insertion member 7 has excellent manufacturability. The reason for this is that the insertion member 7 is a single-piece molded object constituted by a single material, and the cross-sectional shape and the cross-sectional area are uniform and simple in the axial direction of the insertion member 7. As a representative example, the insertion member 7 can be manufactured by cutting an elongated column-shaped or bar-shaped member so as to have a predetermined length.

The insertion member 7 prevents positional shifting of the assembly 10 in the case 5. Accordingly, there is no need to separately dispose a member for positioning the assembly 10 when the raw resin 600 is introduced and allowed to cure.

The case 5 has excellent manufacturability. With the case described in JP 2013-131567A, an introduction path for the raw resin needs to be formed in the case itself. The reactor 1 of the present embodiment does not need such processing of the case.

The reactor 1 of the present embodiment is compact due to the following three points.

The gap between the assembly 10 and the case 5 in the second region 562 can be less than or equal to 1 mm, for example. The case 5 is therefore likely to be smaller.

The space 560 for arrangement of the insertion member 7 is provided on only one end side of the case 5 in the lengthwise direction. With this case 5, the length L5 of the case 5 is likely to be shorter than in the case where the region for arrangement of the insertion member 7 is provided on both sides in the lengthwise direction, for example. Also, with the case 5 of the present embodiment, the length in the widthwise direction is shorter than in the case where the region for arrangement of the insertion member 7 is provided on one side or both sides in the widthwise direction, for example. In view of these points, the case 5 is likely to be smaller.

The length of the assembly 10 in the widthwise direction of the case 5 is less than the length L10 of the assembly 10, which is less than the height H10. For this reason, the area of the bottom portion 51 of the case 5 is smaller than in the case of the storage aspect in later-described Variation 3. Note that the area of the bottom portion 51 is approximately the product of the length along the widthwise direction and the length L10 of the assembly 10.

Also, according to the reactor 1 of the first embodiment, the volume of the first resin portion 61 can be reduced due to the insertion member 7. For this reason, the thermal expansion amount of the first resin portion 61 is likely to be smaller when the temperature rises during usage of the reactor 1. Accordingly, compared to the case where substantially the entirety of the space 560 is filled by the sealing resin portion 6, the sealing resin portion 6, and particularly the first resin portion 61, is less likely to become cracked due to thermal expansion.

The scope of the present disclosure is indicated by the claims rather than by the foregoing description, and all changes which come within the meaning and range of equivalency of the claims are intended to be embraced therein.

For example, at least one of the following changes can be made to the reactor 1 of the first embodiment.

Variation 1

The insertion member 7 has at least one of the following configurations.

The following describes a variation of the insertion member 7 with reference to FIG. 6.

The insertion member 7 according to Variation 1.1 includes the leading end portion 70 and a shaft portion 75. The constituent material of the leading end portion 70 and the shaft portion 75 has a type A durometer hardness of 50 or higher.

The leading end portion 70 is the portion arranged on the bottom portion 51 side of the case 5, and has the end face 71. The shaft portion 75 is the portion arranged on the open side of the case 5, and has the end face 72. The leading end portion 70 and the shaft portion 75 are connected to each other, and are used as an integrated member.

The leading end portion 70 of the present variation is shaped as a cuboid that substantially corresponds to the shape of the space 560, and the area S7 of the end face 71 is greater than or equal to the plane area Smax of the space 560. The constituent material of the leading end portion 70 is a rubber material having a type A durometer hardness of 90 or lower. The length H70 of the leading end portion 70 can be selected as appropriate. In the present variation, the length H70 is greater than or equal to 10% and less than or equal to 40% of the length H7 of the insertion member 7, and is shorter than the length of the shaft portion 75. Note that the length H70 is the length of the insertion member 7 along the axial direction.

The leading end portion 70 of the present variation has a stepped shape, that is to say has portions having different cross-sectional areas with respect to cross-sections taken along a plane orthogonal to the axial direction of the insertion member 7. In the present variation, flange portions are provided at three locations, namely at the end face 71 and the vicinity thereof, at the central portion in the axial direction and the vicinity thereof, and at the face opposite to the end face 71 of the leading end portion 70 and the vicinity thereof. The area of the outline portion of the flange portion is the area S7. The area of the regions of the leading end portion 70 other than the flange portions is smaller than the area S7.

The shaft portion 75 of the present variation is a round bar-shaped member. The cross-sectional shape and the cross-sectional area of the shaft portion 75 along a plane orthogonal to the axial direction of the insertion member 7 are uniform in the axial direction. The plane area and the cross-sectional area of the shaft portion 75 of the present variation are less than the plane area Smax, and are smaller than the area S7 of the end face 71. Furthermore, the plane area and the cross-sectional area of the shaft portion 75 are smaller than the cross-sectional area of the portions of the leading end portion 70 other than the flange portions. The constituent material of the shaft portion 75 of the present variation is a resin such as PPS resin. Also, the hardness of the constituent material of the shaft portion 75 is higher than the hardness of the constituent material of the leading end portion 70.

The insertion member 7 of Variation 1.1 can create the liquid-tight state with the leading end portion 70 as described above, while also being able to reduce the amount of friction when the insertion member 7 is inserted into the space 560. The reason for this is that in the insertion member 7, the length of the portion having the area S7 that is greater than or equal to the plane area Smax is shorter than that of the insertion member 7 described in the first embodiment, and the area of contact between the outer peripheral surface 100 of the assembly 10 and the inner peripheral surface 520 of the case 5 is smaller. In the present variation, only some portions of the leading end portion 70 are in contact with the outer peripheral surface 100 of the assembly 10 and the inner peripheral surface 520 of the case 5, and the remaining portions of the leading end portion 70 and the shaft portion 75 are substantially not in contact with the outer peripheral surface 100 and the inner peripheral surface 520.

Also, the insertion member 7 of Variation 1.1 can create the above-described liquid-tight state while also be able to more reliably press the leading end portion 70. The reason for this is that the hardness of the constituent material of the shaft portion 75 is higher than the hardness of the constituent material of the leading end portion 70, and thus has a higher rigidity.

Also, the insertion member 7 of Variation 1.1 functions as a member for positioning the assembly 10 in the case 5. The reason for this is that even if the plane area of the shaft portion 75 is smaller than the area S7, the leading end portion 70 can come into close contact with the outer peripheral surface 100 of the assembly 10 and the inner peripheral surface 520 of the case 5 (here, the first face 521).

Note that the constituent material of the leading end portion 70 and the constituent material of the shaft portion 75 may be the same. In this case, the insertion member 7 can be a monolithic molded object made of a single material, thus achieving excellent manufacturability. Also, the plane area and the cross-sectional area of the shaft portion 75 may be greater than or equal to the plane area Smax of the space 560. Furthermore, the shape of the shaft portion 75 may be similar to the shape of the leading end portion 70. In this way, the insertion member 7 that includes the leading end portion 70 and the shaft portion 75 has a high degree of freedom in terms of constituent material, shape, and size.

The insertion member 7 includes a portion in which at least one of the cross-sectional shape and the cross-sectional area along the plane orthogonal to the axial direction is different.

As one example, the insertion member 7 has a portion having a locally different cross-sectional area as in Variation 1.1. As another example, the insertion member 7 is a column-shaped or bar-shaped member that is tapered such that the cross-sectional area decreases continuously or in a stepwise manner from the end face 72 arranged on the open side of the case 5 toward the end face 71 arranged on the bottom portion 51 side of the case 5.

Multiple insertion members 7 are provided.

In this case, the insertion members 7 may have the same constituent material or different constituent materials. For example, there may be an insertion member 7 made of an electrically insulating material and an insertion member 7 made of an electrically conductive material.

Also, in this case, the insertion members 7 may be arranged at any position as long as they are side-by-side with the assembly 10. For example, the insertion members 7 are located on one end side of the case 5 in the lengthwise direction, and are arranged along the widthwise direction. Alternatively, the insertion members 7 are divided into groups arranged on both sides in the lengthwise direction. Alternatively, an insertion member 7 may be arranged on one end side of the case 5 in the lengthwise direction and another insertion member 7 may be arranged on one end side in the widthwise direction. As a specific example, the former insertion member 7 is the insertion member 7 described in the first embodiment, and the latter insertion member 7 is a plate-shaped insertion member 7 arranged extending along the third face 523 of the case 5, for example. The insertion member 7 described in the first embodiment and the plate-shaped insertion member 7 are arranged so as to form an "L" in the case 5. The sizes of the insertion members 7 are adjusted such that the end portions do not interfere with each other.

Variation 2

Neither the assembly 10 nor the insertion member 7 are completely embedded in the sealing resin portion 6, and a portion of the assembly 10 and/or the insertion member 7 is exposed.

Variation 2 makes it possible to further reduce the filler amount of the sealing resin portion 6, and can also shorten the filling time. For example, in the case where a portion of the assembly 10 is exposed from the sealing resin portion 6, if the second resin portion 62 fills at least the space between the outer peripheral faces of the winding portions 21 and 22 and the inner peripheral surface 520 of the case 5, and covers the outer peripheral faces of the winding portions 21 and 22, excellent heat dissipation performance and insulation performance are achieved, which is preferable.

Variation 3

The assembly 10 is stored in the case 5 in the state described below.

When the assembly 10 is stored in the case 5, the axial direction of the winding portions 21 and 22 is orthogonal to the depth direction of the case 5, and the axes of the winding portions 21 and 22 are at the same position in the depth direction. This storage state is the storage state described in JP 2013-131567A.

When the assembly 10 is stored in the case 5, the axial direction of the winding portions 21 and 22 is orthogonal to the depth direction of the case 5, and the axes of the winding portions 21 and 22 are side-by-side in the depth direction.

In both of these storage aspects, the outer core portions 33 of the assembly 10 are arranged close to each other on respective sides in the lengthwise direction of the case 5. As a representative example, the insertion member 7 is arranged extending along the outer core portions 33 or along the holding members 4 that cover the outer core portions 33.

Variation 4

The coil 2 has at least one of the configurations below.

The winding portions 21 and 22 are constituted by mutually different winding wires.

In this case, the coupling portion may be obtained by the end portions of the winding wires that are not connected to the external apparatus being directly connected to each other by performing welding, crimping, or the like, or being indirectly connected using a fitting.

The winding wires may be wires that are not coated rectangular wires, such as coated round wires having a round cross-section.

The winding portions 21 and 22 are not required to be shaped as cornered tubes, and may be cylindrical or the like.

The winding portions 21 and 22 have different specifications.

There is only one winding portion.

Variation 5

The magnetic core 3 has at least one of the following configurations.

The magnetic core 3 is constituted by one, two, three, or five or more core pieces.

The magnetic core 3 includes a core piece that has a portion arranged inside a winding portion of the coil 2 and a portion arranged outside of the winding portion. Examples of such a core piece include a U-shaped core piece, an L-shaped core piece, and an E-shaped core piece.

At least either the inner core portion 31 or 32 is constituted by multiple core pieces rather than one core piece. In this case, a magnetic gap may be provided between adjacent core pieces.

The outer peripheral shape of the inner core portions 31 and 32 is not similar to the inner peripheral shape of the winding portions 21 and 22. For example, the winding portion 21 is shaped as a quadrangular tube, and the inner core portion 31 is shaped as a circular column.

The corner portions of the core pieces have been chamfered. With chamfered core pieces, the corner portion are not likely to become chipped, thus achieving excellent strength.

Variation 6

The reactor 1 includes an adhesive layer (not shown) between the assembly 10 and the inner bottom face of the bottom portion 51 of the case 5.

Variation 7

The resin molded portion 8 and/or the holding member 4 are omitted from the reactor 1.

What is claimed is:

1. A reactor comprising:

an assembly including a coil and a magnetic core;

a case in which the assembly is stored;

an insertion member that is stored side-by-side with the assembly in the case; and a sealing resin portion that fills the case;

wherein the case includes a bottom portion and a side wall portion, the insertion member includes a leading end portion disposed so as to be separated from the bottom portion via a gap, a space formed between the assembly and the case and between the insertion member and the case includes a first region provided between the bottom portion and the leading end portion and a second region that is a region other than the first region, the sealing resin portion includes a first resin portion that fills the first region and a second resin portion that fills at least a portion of the second region, and a constituent material of the insertion member has a type A durometer hardness of 50 or higher.

2. The reactor according to claim 1, wherein the constituent material contains a resin or a rubber material.

3. The reactor according to claim 2, wherein the constituent material of the leading end portion is the rubber material, and the leading end portion includes an end face that is in contact with the first resin portion, and the area of the end face of the leading end portion when not undergoing elastic deformation is greater than or equal to a maximum plane area of the first region.

4. The reactor according to claim 1, wherein the length of the insertion member along a depth direction of the case is greater than or equal to 40% of the depth of the case.

5. The reactor according to claim 1, wherein a constituent material of the sealing resin portion contains a resin and a powder made of a non-metallic inorganic material.

6. The reactor according to claim 2, wherein the length of the insertion member along a depth direction of the case is greater than or equal to 40% of the depth of the case.

7. The reactor according to claim 3, wherein the length of the insertion member along a depth direction of the case is greater than or equal to 40% of the depth of the case.

8. The reactor according to claim 2, wherein a constituent material of the sealing resin portion contains a resin and a powder made of a non-metallic inorganic material.

9. The reactor according to claim 3, wherein a constituent material of the sealing resin portion contains a resin and a powder made of a non-metallic inorganic material.

10. The reactor according to claim 4, wherein a constituent material of the sealing resin portion contains a resin and a powder made of a non-metallic inorganic material.

* * * * *